US006059674A

United States Patent [19]

Umlauft

[11] Patent Number: 6,059,674

[45] Date of Patent: May 9, 2000

[54] RACQUETBALL RACQUET

[75] Inventor: Helmut Umlauft, Hard, Austria

[73] Assignee: Head Sport Aktiengesellschaft, Kennelbach, Austria

[21] Appl. No.: 08/985,267

[22] Filed: Dec. 4, 1997

[51] Int. Cl.[7] ..... A63B 49/02

[52] U.S. Cl. ..... 473/537; 473/540; 473/543

[58] Field of Search ..... 473/537, 535, 473/540, 541, 543, FOR 177, FOR 171, 536

[56] References Cited

U.S. PATENT DOCUMENTS

| | | | |
|---|---|---|---|
| Re. 34,067 | 9/1992 | Mortvedt et al. | 473/537 |
| Re. 34,068 | 9/1992 | Mortvedt et al. | 473/537 |
| 4,322,076 | 3/1982 | Bertram et al. | 473/537 |
| 4,531,738 | 7/1985 | Mortvedt et al. | 473/537 |
| 5,368,295 | 11/1994 | Severa et al. | 473/535 |
| 5,540,434 | 7/1996 | Garrett, Jr. et al. | 473/536 |
| 5,562,283 | 10/1996 | Davis et al. | 473/540 |
| 5,649,702 | 7/1997 | Janes et al. | 473/537 |
| 5,716,296 | 2/1998 | Umlauft | 473/537 |
| 5,779,573 | 7/1998 | You . | |
| 5,833,560 | 11/1998 | Davis et al. | 473/537 |

*Primary Examiner*—Raleigh W. Chiu
*Attorney, Agent, or Firm*—Finnegan, Henderson, Farabow, Garrett & Dunner, L.L.P.

[57] ABSTRACT

This invention provides for a racquetball racquet combining enhanced ball acceleration, high precision, and comfort. These optimum characteristics are achieved though a racquetball racquet having, in combination, an overall length of between 500 mm and 580 mm, an unstrung weight of between 140 g and 195 g, a head weight of between 52% and 65% of the overall racquet weight, and a center of gravity located between 25 mm relative to the racquet head handle end and 75 mm relative to the distal head end, measured along the longitudinal axis of the racket. The longitudinal strings of the racquetball racquet extend from the racquet head handle end to the racket head distal end are arranged so as to diverge to form a V-configuration. Two neighboring longitudinal strings are each led to a common location on the racquet head handle end.

6 Claims, 1 Drawing Sheet

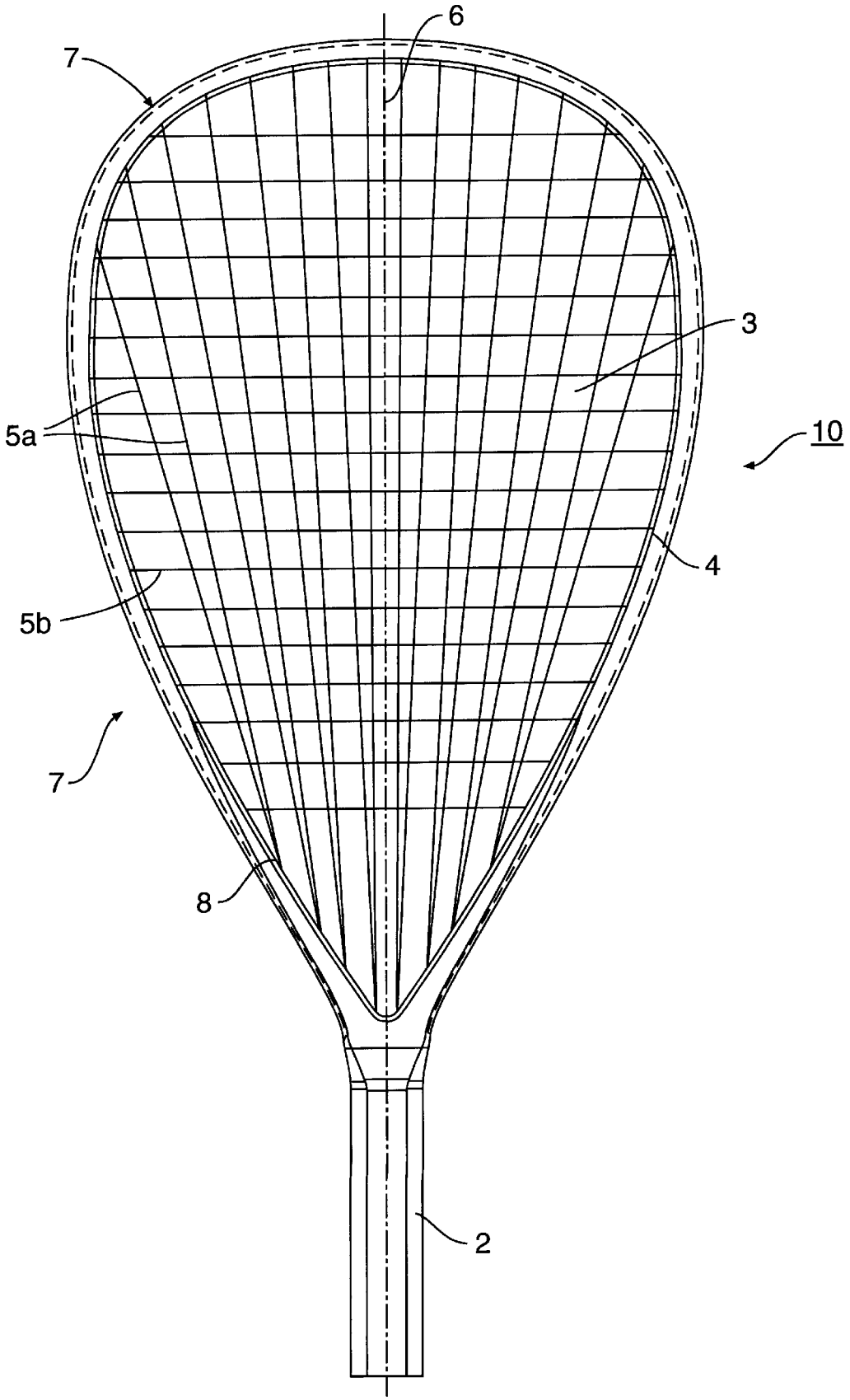
6
7
3
5a
10
4
5b
7
8
2

RACQUETBALL RACQUET

BACKGROUND OF THE INVENTION

1. Technical Field

The invention relates to a racquetball racquet comprising a ball striking surface, a racquet head frame, and a racquet handle.

Certain properties of racquets are relevant to racquetball playing such as maneuverability and ball acceleration, as well as the vibration and damping behavior. Performance of conventional racquets is generally controlled via the materials and cross sections used in the racquet handle and in the racquet head. Various materials have been used in the past for the construction of such racquets in attempts to improve the maneuverability and ball acceleration as well as the vibration and damping behavior. Various materials have been used in the past for the construction of tennis racquets, in particular, to increase the vibration frequency (eigenfrequency) by choosing newer and lighter materials. An increase in the vibration frequency is intended to avoid undesired rebounding shocks resulting in excessive stresses on the player's arm and wrist, while obtaining enhanced maneuverability of the racquet through lower racket weight.

With racquetball racquets, conditions are, however, completely different than tennis racquets due to the different dimensions and hence the substantially lower weight of racquetball racquets. For racquetball racquets, a mere change in weight by utilizing lighter and optionally stiffer materials by no means necessarily results in an improved performance of the racquetball racquet.

An essential prerequisite in the construction of racquetball racquets having midsized and oversized impact surfaces resides in that even with different points of impact of the ball on the racquet head and, in particular, impact points which are offset from the longitudinal axis of the racquet, the racquet head provides a consistent return and high acceleration to the ball.

2. Prior Art

In U.S. Pat. Nos. Re. 34,067 and Re. 34,068, racquetball racquets are described, which, based on their geometric dimensions, overall and striking surface lengths, widths at weight ranges from 220 g to 270g, and respective mass distributions, yield frame stiffness intended to guarantee a desirable performance of the racquet. However, the racquets of U.S. Pat. Nos. Re. 34,067 and Re. 34,068 have relatively high weights, thus causing unfavorable vibrations in the player's wrist.

SUMMARY OF THE INVENTION

The present invention includes a racquetball racquet providing enhanced ball acceleration and consistent return. The present invention further includes a racquetball racquet having a low weight and hence a more rapid racquet acceleration while, at the same time, offering a desirable racquet performance.

BRIEF DESCRIPTION OF THE DRAWING

In the following, the invention will be explained in more detail by way of an exemplary embodiment presented in the Figure, which shows a frontal view of a racquetball racquet of the present invention.

DESCRIPTION OF A PREFERRED EMBODIMENT

The present invention essentially consists of a racquetball racquet having an overall length of between 500 mm and 580 mm, an unstrung weight of between 140 g and 195 g, a head weight of between 52% and 65% of the overall racquet weight and a center of gravity located on the racquet head along the longitudinal axis of the racquet, at a point between 25 mm from the racquet head handle end and 75 mm from the racquet head distal end. Pairs of racquet string portions extend generally longitudinally from the handle end of the racquet head to the distal end of the racquet head, and are arranged so as to diverge towards the distal end of the racquet head in a V-shaped configuration. Each pair of longitudinal strings are led to a common location on the handle end of the frame. Unexpectedly, a racquetball racquet made in accordance with the present invention provides significantly better racquet maneuverability than is present in prior art rackets, while maintaining consistent return. The V-shaped stringing configuration is of specific importance.

Head weight, as defined herein, is measured by supporting the racquet handle such that the racquet extends horizontally. The resulting downward force on the distal end of the racquet head based on the weight of the racquet head is the "head weight." A racquet whose head weight is larger than half of the overall racquet weight is "head-heavy," whereas a racket having a head weight less than half of the overall racquet weight is "handle-heavy." The racquet of the present invention, having an unstrung weight of 140 g to 195 g, preferably less than 175 g, and a head weight of more than 52% of the overall racquet weight, provides a slightly head-heavy racket in the strung state.

In this manner, a racquetball racquet allowing quick reflex play is provided, the racquet being movable to hit a racquetball at a high speed due to its low weight and its desirable head-heavy weight distribution.

Conventional light racquets having a head weight of more than 52% of the overall racquet weight have a higher overall racquet weight than the present invention. Conventional light racquets therefore have higher mass moments of inertia which strongly affects the maneuverability of the racket.

The balance of the racquet of the present invention, despite a reduced overall racquet weight, results in a high degree of stability and an extremely precise racquet performance thus far obtainable only by means of substantially heavier rackets. In the present invention, it is advantageous to string the racquet with higher stringing forces. While conventional rackets usually are strung with approximately 12 kg to 14 kg, racquets according to the present invention preferably are to be strung with 14 kg to 20 kg.

According to a preferred further development of a racquetball racquet according to the present invention, the mass moment of inertia of the racquet about its handle is lessr than 24 $gm^2$.

The mass moment of inertia about the handle of the racquet is measured in the racquet's stringing plane. The maximum values of the mass moment of inertia about the distal end of the racquet head, and the mass moment of inertia of the racquet about the racquet handle lie below known values. It was unexpectedly discovered that a higher ball acceleration could be attained at a higher striking precision and stability despite the substantially lower mass moments of inertia of the racquet of the present invention. This surprising deviation from what would have been expected is attributed to the characteristics of the invention cumulatively, wherein a particularly light and rapidly accelerated racquetball racquet may be obtained, in particular, based on the overall racquet weight, the weight distribution, and the V-type stringing.

In the racquet of the present invention, the dynamic center of gravity, also called the center of percussion, is shifted towards the racquet head while the ratio of the racquet head weight to the overall racquet weight is maintained. Therefore, the point of impact of the ball on the racquet head, when the ball is hit in the upper third of the striking surface of the racquet head, is located almost in the dynamic center of gravity, thus avoiding undesired rebounding shocks causing tremendous stresses on the player's arm and wrist.

The dynamic center of gravity is determined by dividing the mass moment of inertia by the product of the racquet mass and the static center of gravity. The static center of gravity corresponds to a distance from the handle end of the racquet. The handle end of the racquet also serves as a point of origin for determining the dynamic center of gravity.

Furthermore, marked improvements in the precision and maneuverability of the racquet of the present invention are obtained by the bifilar moment of inertia relative to the longitudinal axis of the racquet being larger than 9000 $gcm^2$. This ensures that even balls impacting the racquet head at a point offset from the longitudinal axis of the racquet will have a consistent return, thus increasing racquet precision to a considerably advantageous degree. The bifilar moment of inertia is determined by measuring pendulum movements of the racket about its longitudinal axis.

A vibration frequency in the first mode under free-free suspension of the racket, of more than 200 Hz has proved advantageous in avoiding undesirable stresses on the player's arm and wrist. A pleasant playing performance for the racquet of the present invention is thereby created, with the striking precision being clearly enhanced.

In the present invention, particularly advantageous racquet performance has been obtained by making the distance of the center of percussion of the striking surface from the static point of balance larger than 100 mm, and spacing the center of percussion more than 390 mm from the handle end of the racquet.

If the overall racquet weight is set according to the above-listed parameters, this will result in significant improvements over the light-weight rackets available on the market. According to the invention, a ratio of overall racquet weight to head weight of more than 2.05 and a center of gravity distance of more than 290 mm has proved particularly advantageous for providing a neutral playing behavior, and yielding a well-balanced, rapidly accelerating racquetball racquet having a high degree of striking precision.

Particularly good ball control is obtained by a configuration in which the distance of the center of percussion from the physical center of gravity of the strung area of the striking surface of the racquet is larger than 40 mm.

In the Figure, a racquetball racquet is denoted by 1. The racquet includes a handle portion 2 and a racquet head 10 having a striking surface 3 delimited by frame members 4. The frame members 4 comprise respective bores for striking surface strings, which comprise longitudinal strings 5*a* and cross strings 5*b*. The configuration of the striking surface strings is chosen such that the longitudinal strings 5*a* are configured to diverge towards the distal end 7 of the racquet head 10 on both sides of the longitudinal axis 6 of the racquet 1. The two longitudinal strings 5*a* begin from a common point 8 on a side of the racquet frame 4 adjacent the racquet handle 2, and are thereby arranged in a substantially V-shaped manner. Given the low racquet weight of the present invention, such a V-shaped longitudinal string configuration results in enhancement of ball acceleration and improved directional stability, such that the racquet of the present invention stands out for its improved overall length and its low head-heaviness at an extremely low weight.

I claim:

1. A racquetball racquet comprising:

a racquet handle; and a racquet head extending from the racquet handle, the racquet head including a handle end, a distal end, and a racquet head frame, the racquet head frame defining a ball striking surface, the ball-striking surface having a plurality of string portions extending generally in a racquet longitudinal direction from the handle end of the racquet head to the distal end of the racquet head, at least one pair of string portions diverging from a common location on the racquet frame adjacent the handle end and extending toward the distal end of the racquet head to form a V-configuration;

wherein the racquet includes, an overall length of between 500 mm and 580 mm, an unstrung weight of between 140 g and 195 g, a strung weight of the racquet head of between 52% and 65% of the total racquet weight, and a center of gravity located along a longitudinal axis of the strung racquet between 25 mm from the racquet head handle end and 75 mm from the racquet head distal end; and wherein a strung racquet mass moment of inertia about the racquet handle is less than 24 $gm^2$.

2. A racquetball racquet comprising:

a racquet handle; and a racquet head extending from the racquet handle, the racquet head including a handle end, a distal end, and a racquet head frame, the racquet head frame defining a ball striking surface, the ball-striking surface having a plurality of string portions extending generally in a racquet longitudinal direction from the handle end of the racquet head to the distal end of the racquet head, at least one pair of string portions diverging from a common location on the racquet frame adjacent the handle end and extending toward the distal end of the racquet head to form a V-configuration;

wherein the racquet includes, an overall length of between 500 mm and 580 mm, an unstrung weight of between 140 g and 195 g, a strung weight of the racquet head of between 52% and 65% of the total racquet weight, and a center of gravity located along a longitudinal axis of the strung racquet between 25 mm from the racquet head handle end and 75 mm from the racquet head distal end; and wherein a strung racquet bifilar moment of inertia about the longitudinal axis of the racquet is greater than 9000 $g\text{-}cm^2$.

3. A racquetball racquet comprising:

a racquet handle; and a racquet head extending from the racquet handle, the racquet head including a handle end, a distal end, and a racquet head frame, the racquet head frame defining a ball striking surface, the ball-striking surface having a plurality of string portions extending generally in a racquet longitudinal direction from the handle end of the racquet head to the distal end of the racquet head, at least one pair of string portions diverging from a common location on the racquet frame adjacent the handle end and extending toward the distal end of the racquet head to form a V-configuration;

wherein the racquet includes, an overall length of between 500 mm and 580 mm, an unstrung weight of between 140 g and 195 g, a strung weight of the racquet head of between 52% and 65% of the total racquet weight, and a center of gravity located along a longitudinal axis of the strung racquet between 25 mm from the racquet head handle end and 75 mm from the racquet head distal end; and wherein a strung racquet vibration frequency measured in a first mode under free-free suspension is greater than 200 Hz.

4. A racquetball racquet comprising:

a racquet handle; and a racquet head extending from the racquet handle, the racquet head including a handle end, a distal end, and a racquet head frame, the racquet head frame defining a ball striking surface, the ball-striking surface having a plurality of string portions extending generally in a racquet longitudinal direction from the handle end of the racquet head to the distal end of the racquet head, at least one pair of string portions diverging from a common location on the racquet frame adjacent the handle end and extending toward the distal end of the racquet head to form a V-configuration;

wherein the racquet includes, an overall length of between 500 mm and 580 mm, an unstrung weight of between 140 g and 195 g, a strung weight of the racquet head of between 52% and 65% of the total racquet weight, and a center of gravity located along a longitudinal axis of the strung racquet between 25 mm from the racquet head handle end and 75 mm from the racquet head distal end; and wherein the ball striking surface has a center of percussion located more than 100 mm from a static balance point of the racquet.

5. A racquetball racquet comprising:

a racquet handle; and a racquet head extending from the racquet handle, the racquet head including a handle end, a distal end, and a racquet head frame, the racquet head frame defining a ball striking surface, the ball-striking surface having a plurality of string portions extending generally in a racquet longitudinal direction from the handle end of the racquet head to the distal end of the racquet head, at least one pair of string portions diverging from a common location on the racquet frame adjacent the handle end and extending toward the distal end of the racquet head to form a V-configuration;

wherein the racquet includes, an overall length of between 500 mm and 580 mm, an unstrung weight of between 140 g and 195 g, a strung weight of the racquet head of between 52% and 65% of the total racquet weight, and a center of gravity located along a longitudinal axis of the strung racquet between 25 mm from the racquet head handle end and 75 mm from the racquet head distal end; and wherein the ball striking surface has a center of percussion located more than 390 mm from a proximal racquet handle end.

6. A racquetball racquet comprising:

a racquet handle; and a racquet head extending from the racquet handle, the racquet head including a handle end, a distal end, and a racquet head frame, the racquet head frame defining a ball striking surface, the ball-striking surface having a plurality of string portions extending generally in a racquet longitudinal direction from the handle end of the racquet head to the distal end of the racquet head, at least one pair of string portions diverging from a common location on the racquet frame adjacent the handle end and extending toward the distal end of the racquet head to form a V-configuration;

wherein the racquet includes, an overall length of between 500 mm and 580 mm, an unstrung weight of between 140 g and 195 g, a strung weight of the racquet head of between 52% and 65% of the total racquet weight, and a center of gravity located along a longitudinal axis of the strung racquet between 25 mm from the racquet head handle end and 75 mm from the racquet head distal end; and wherein the ball striking surface has a center of percussion located more than 40 mm from the physical center of gravity of a strung area forming the ball striking surface.

* * * * *